US005692376A

United States Patent [19]

Miki et al.

[11] Patent Number: 5,692,376

[45] Date of Patent: Dec. 2, 1997

[54] CONTROL CIRCUIT FOR A CONSTRUCTION MACHINE

[75] Inventors: Masatoshi Miki; Yoshinori Yamagishi, both of Kobe; Makoto Hirano, Kakogawa, all of Japan

[73] Assignee: Shin Caterpillar Mitsubishi Ltd., Tokyo, Japan

[21] Appl. No.: 723,870

[22] Filed: Sep. 30, 1996

[30] Foreign Application Priority Data

Oct. 11, 1995 [JP] Japan ..... 7-263146

[51] Int. Cl.[6] ..... F16D 31/02

[52] U.S. Cl. ..... 60/328; 60/368; 60/445; 60/449

[58] Field of Search ..... 60/328, 368, 445, 60/449; 91/432

[56] References Cited

U.S. PATENT DOCUMENTS

| | | | |
|---|---|---|---|
| 3,865,013 | 2/1975 | Mastaj | 91/432 |
| 4,507,057 | 3/1985 | Igarashi et al. | 417/218 |
| 4,811,561 | 3/1989 | Edwards et al. | 60/368 |
| 5,050,379 | 9/1991 | Nagai et al. | 60/449 |
| 5,148,676 | 9/1992 | Moriya et al. | 91/28 |
| 5,315,827 | 5/1994 | Imai et al. | 60/452 |

FOREIGN PATENT DOCUMENTS

| | | | |
|---|---|---|---|
| 279101 | 11/1989 | Japan | 60/368 |

*Primary Examiner*—F. Daniel Lopez
*Attorney, Agent, or Firm*—Morrison Law Firm

[57] ABSTRACT

Each attachment for a hydraulically actuated device includes a digitally coded connector which informs a control device about its identity. The control device includes a library which relates the digitally coded identity with fluid parameters of pressure and flow rate required for operation of the hydraulically operated device. The control device outputs signals which control the accelerator of an engine, and also controls pump operations to establish the fluid parameters appropriate for the hydraulically actuated device. When a second device is actuated simultaneously with the original device, the control device automatically compensates with adjusted fluid parameters to permit optimum operation of both devices at the same time.

6 Claims, 4 Drawing Sheets

CONTROL CIRCUIT FOR A CONSTRUCTION MACHINE

FIELD OF INVENTION

The present invention generally relates to a control circuit for a construction machine, such as a hydraulic excavator, a back hoe and a loader, and more particularly relates to a control circuit which enables an operator who is selecting an attachment from among various attachments to be mounted on the front part of a hydraulic excavator or the like, to set such conditions as discharge pressure, flow rate and so forth with a minimal operation according to the specific requirements of the selected attachment.

BACKGROUND

Referring to FIG. 3, a typical application includes a hydraulic excavator 100 normally equipped with a bucket (not shown) attached to the front part thereof. Hydraulic excavator 100 may be used for other tasks using different attachments such as, for example, a hydraulic hammer 1 attached thereto instead of a bucket. Hydraulic hammer 1 may be repositioned at the will of the operator by elevating one or more booms 2*a* under urging from appropriate hydraulic cylinders 2, and by rotating hydraulic excavator 100 in a conventional manner. Many other attachments may be substituted for hydraulic hammer 1 do to a large number of different tasks. This flexibility is one of the greatest benefits of hydraulic excavator 100 and is one reason for its popularity.

Each of these attachments, however, requires its own respective ranges of pressures and flow rates of hydraulic fluid. The different control criteria for each attachment must be set at the main body of the hydraulic excavator 100. In the case of a hydraulic hammer 1, for example, rated pressure and flow rate differ between different hydraulic hammers 1 depending on the manufacturer and the capacity of hydraulic hammer 1, as well as between hydraulic hammer 1 and other types of attachments.

Referring now to FIG. 4, a typical prior-art control system shown generally at 102 includes resistors 19, 20 connected between a battery 21 and separate elements of a manual switch 22. The resistance values of resisters 19, 20 are selected to adapt various rated fluid pressures and flow rates according to the particular attachment in use. The outputs of manual switch 22 are connected to proportional control solenoid valves 14, 15 which transform electrical signals, electric current in this case, into hydraulic pressure signals representing hydraulic pressures. The hydraulic pressure signals are applied to pump regulators 12, 13. Pump regulators 12, 13 control the discharge pressure of hydraulic pumps 8 and 9 at values which maintain the power fed from an engine 10 to hydraulic pumps 8, 9 at a constant level. Thus, the hydraulic fluid discharged by hydraulic pumps 8, 9 permits hydraulic hammer 1 to function in its rated operating condition.

Hydraulic hammers 1 from different manufacturers normally have different rated pressure and flow rate. Other types of devices also have different pressure and flow rate requirements. When hydraulic hammer 1 is changed to a different device, resistors 19, 20 must be changed also. This is inconvenient, and interferes with efficient operation of hydraulic excavator 100.

A hydraulic excavator is normally adjusted to operate at maximum power output. In other words, it is controlled such that the driving source, i.e. diesel engine 10, is driven as nearly as possible at its rated output power at all times.

The speed of engine 10 is set manually by an accelerator dial 17. Signals from accelerator dial 17 are input to a control device 18. An rpm signal from engine 10 is detected by a sensor 16 and applied to control device 18.

The commanded engine speed set by accelerator dial 17 is compared in control device 18 with the actual engine speed input from sensor 16. Control device 18 computes a value for input to driving accelerator actuator 11 that will adjust the actual engine speed to a value substantially equal to the set speed. The output of driving accelerator actuator 11 adjusts the speed of engine 10 to maintain a substantially constant output at the value commanded by control device 18.

When the accelerator reaches its maximum, and the engine speed exceeds its rated value, control device 18 outputs signals to proportional control solenoid valves 14, 15 and thereby to pump regulators 12, 13 which increase the output flow from hydraulic pumps 8, 9 and thereby reduce motor speed by increasing loading. On the contrary, when the engine speed decreases below the rated value, control device 18 produces output signals that reduce the outputs of hydraulic pumps 8, 9 thereby reducing the load on engine 10, and returning its speed to the design value.

When the construction machine works with a hydraulic hammer 1 or any other attachment mounted thereon, a pedal type operating device 6 or the like drives a control valve 4 which, in turn, controls the application of hydraulic fluid to hydraulic hammer 1. However, the need to manually operate manual switch 22 to transfer control between resistors 19, 20 and control device 18 being placed in operation is a drawback.

A boom control valve 5 is actuated by a lever type operating device 7 to apply hydraulic pressure to, for example, boom cylinder 2 (FIG. 3) for lowering and raising a boom 2*a*. When boom 2*a* is moved at the same time that hydraulic hammer 1 (or other attachment), is operated, fluid from hydraulic pumps 8, 9 is divided into the two paths to hydraulic hammer 1 and boom cylinder 2. The resulting reduction of fluid flow to hydraulic hammer 1 interferes with effective operation of hydraulic hammer 1.

Those skilled in the art will recognize that hydraulic excavator 100 may have more than one hydraulic cylinder for actuation of its parts. Besides boom cylinder 2, hydraulic fluid may be diverted to actuate a stick or to rotate the upper body of hydraulic excavator 100.

A flow control valve 3 is disposed in the downstream side of a center by-pass line of control valves 4, 5. A control line (not shown) from flow control valve 3 is connected to pump regulators 12, 13 to produce what is generally called a negative control in which the flow rate is low when the pressure is high, while the flow rate increases as pressure decreases.

The conventional control circuit described above can cope with only a single attachment, such as hydraulic hammer 1. Although this problem may be solved by switching between a number of resistors 19, 20 and switches 22, the complicated and troublesome task of changing resistors 19, 20 and operating switches 22 is still necessary. Not only does this prior art system carry the danger of making mistakes in changing the resistors or operating the switches, but it also has the drawback of increased production costs. Therefore, providing a large number of resistors and switches is not a practical solution to the problem.

Furthermore, the above method is not effective in operating the attachment together with another actuator, such as boom cylinder 2, because splitting the hydraulic fluid hinders normal functioning of the attachment.

OBJECTS AND SUMMARY OF THE INVENTION

In order to solve the above problems, an object of the present invention is to provide a construction machine control circuit that ensures that the pumps function in the optimal condition for the attachment which is currently being operated.

Another object of the present invention is to enable anyone to select easily and without error the appropriate pump control criteria from among various control criteria respectively required by a plurality of attachments.

Yet another object of the present invention is to provide a construction machine control circuit that is free from the danger of the attachment being hindered from functioning properly when working together with another actuator.

According to an embodiment of the invention, there is provided a control circuit of a construction machine having an attachment and another actuator, which are both components of the working equipment of the construction machine, pumps for feeding hydraulic fluid through control valves to the attachment and the actuator, and a control device for controlling discharge rates of the pumps, the control circuit including a control criteria selecting means for selecting from among a plurality of pump control criteria set in the aforementioned control device the pump control criteria that correspond to the attachment to be used, and detectors for detecting the state of operation of the attachment and causing the control device to output the pump control criteria selected by the control criteria selecting means.

With the configuration as above, when the detectors detect operation of the attachment, the control circuit controls the pumps according to the pump control criteria which are associated with the attachment currently in use and have been retrieved from the control device by the control criteria selecting means.

According to a feature of the invention, there is provided a control circuit of a construction machine wherein the control criteria selecting means comprises connectors to be respectively attached to different attachments, each connector having a plurality of cables and, by means of grounding a specific cable or cables from among the plurality of cables, setting the bit pattern associated with the attachment to which the connector is connected, and the connector attached to the currently used attachment is connected through harnesses to the control device, which is provided at the main body of the construction machine.

Set values of pump control criteria that would respectively correspond to the bit patterns of all the attachments to be used are stored in the control device. With the configuration as above, when operation of the attachment is detected, the control device retrieves the set values representing the control criteria that corresponds to the bit pattern characteristic to the currently used attachment and outputs the appropriate pump control signals, thereby controlling the pumps.

According to a further feature of the invention, there is provided a control device which adds correction values to the already chosen pump control criteria, when a detector detects operation of another actuator, and then outputs the corrected control criteria, the correction values being computed based on the degree of operation of said other actuator.

When another actuator is simultaneously operated with the attachment, the system is capable of driving both properly by automatically correcting the originally selected pump control criteria in accordance with the degree of operation of the other actuator, thereby ensuring a pump discharge rate that is satisfactory for simultaneous operation of the attachment and the actuator.

In a further embodiment of the invention, a control circuit of a construction machine produces pump control criteria that control the respective pumps in addition to controlling the accelerator of the engine that drives the pumps.

Furthermore, when operation of the attachment is detected, the control device in which the set values of the pump control criteria that would respectively correspond to the bit patterns of all the attachments to be used have been stored retrieves the set values representing the control criteria that correspond to the bit pattern of the currently used attachment and outputs the appropriate pump control signals, thereby controlling the pumps. When another actuator is simultaneously operated with the attachment, the control device computes the values to correct the accelerator position and the pump output in order to increase the pump discharge rate and adds the computed correction values to the originally selected pump control criteria, the correction values corresponding to the degree of operation of the actuator, and then outputs the corrected values, thereby ensuring a pump discharge rate sufficient for simultaneous operation of the attachment and the actuator.

Briefly stated, the present invention provides a system in which each attachment for a hydraulically actuated device includes a digitally coded connector which informs a control device about its identity. The control device includes a library which relates the digitally coded identity with fluid parameters of pressure and flow rate required for operation of the hydraulically operated device. The control device outputs signals which control the accelerator of an engine, and also controls pump operations to establish the fluid parameters appropriate for the hydraulically actuated device. When a second device is actuated simultaneously with the original device, the control device automatically compensates with adjusted fluid parameters to permit optimum operation of both devices at the same time.

According to an embodiment of the invention, there is provided a control circuit of a machine having at least an attachment and an actuator comprising: at least one pump for feeding hydraulic fluid to the attachment and the actuator, a first control valve controlling the flow of the hydraulic fluid to the attachment, a second control valve controlling the flow of the hydraulic fluid to the actuator, a control device for controlling respective discharge rates of the pumps, a control criteria selecting means in the control device for selecting from among at least first and second pump control criteria, the first pump control criterion corresponding to a first attachment, and the second pump control criterion corresponding to a second, different, attachment, a coding device uniquely associated with each of the first and second attachments, and means connected to the control device for detecting which specific one of the first attachment and the second attachment is affixed to the machine, and for selecting the related one of the first and second pump control criteria.

According to a feature of the invention, there is provided a control circuit for a machine having at least a first and a second attachment attachable to the machine, comprising: a first coding device affixed to the first attachment, a second coding device affixed to the second attachment, the first coding device being attached to the control circuit when the first attachment is installed on the machine, the second coding device being attached to the control circuit when the second attachment is installed on the machine, means in the control device for detecting a unique code in the first or second coding device, the control device including at least a first control criteria related to the first attachment, and at least a second control criteria related to the second attachment, and means for applying the first control criteria to control of the first attachment when the unique code identifies the first attachment, and for applying the second control criteria to control of the second attachment when the unique code identifies the second attachment.

The above, and other objects, features and advantages of the present invention will become apparent from the following description read in conjunction with the accompanying drawings in which like reference numerals designate the same elements.

DETAILED DESCRIPTION OF THE PREFERRED EMBODIMENTS

Figure 1A:
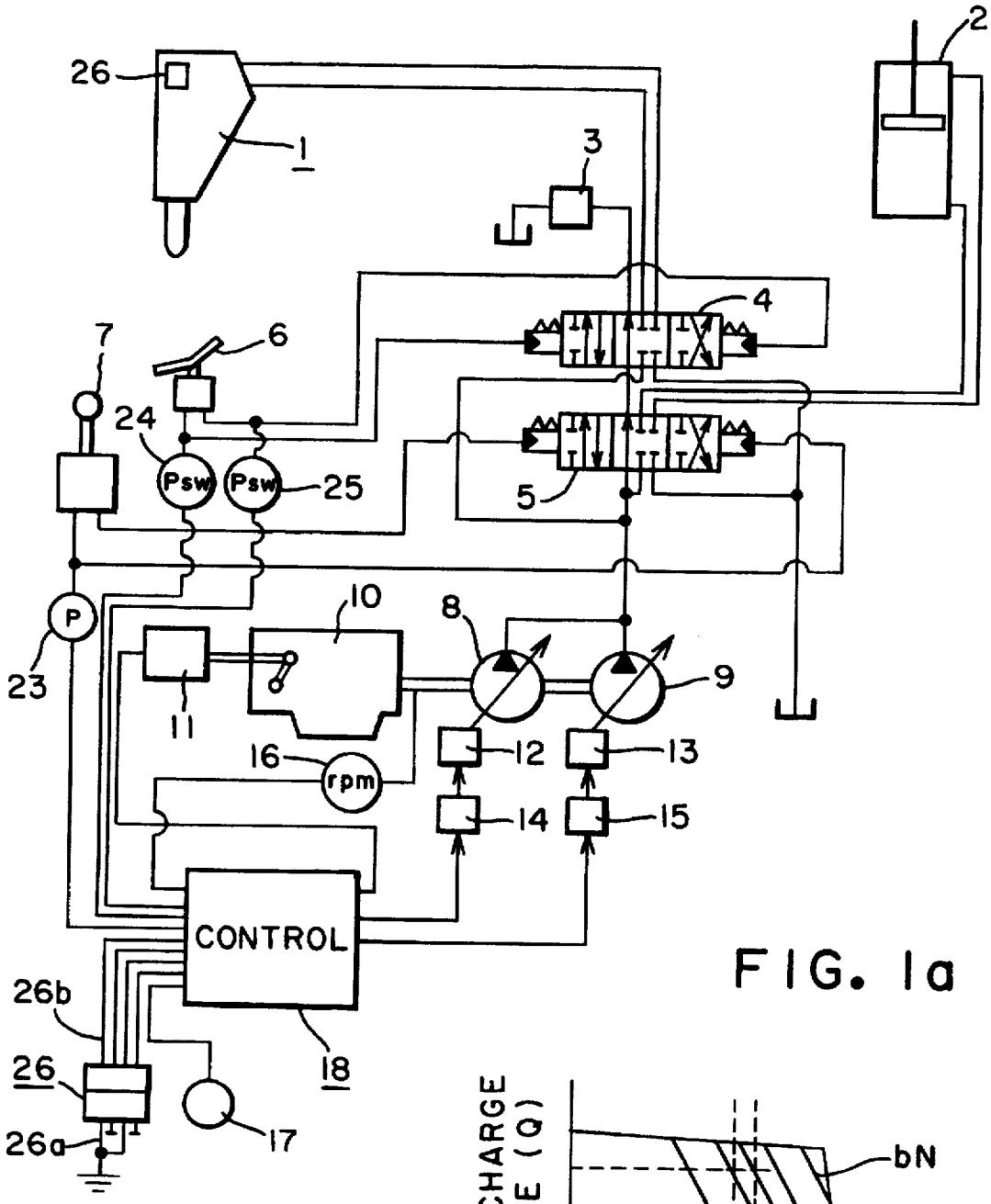
FIG. 1*a* is a circuit diagram of a construction machine control system according to an embodiment of the present invention

Referring to FIG. 1*a*, hydraulic pumps 8, 9 feed hydraulic fluid through control valves 4, 5 to an attachment such as, for example, hydraulic hammer 1, and another actuator such as, for example, boom cylinder 2. Additional actuators (not shown) may also be installed, but full disclosure of the invention is considered sufficient using the simplified case of two attachments.

Discharge flow rates of hydraulic pumps 8, 9 is controlled by the speed of diesel engine 10. The speed of diesel engine 10 is adjusted by accelerator actuator 11. The outputs of hydraulic pumps 8 and 9 are respectively controlled by pump regulators 12, 13.

Accelerator actuator 11 and pump regulators 12, 13 perform adjustment based on signals output from control device 18. Pump regulators 12, 13 are responsive to variable hydraulic control pressures from proportional control solenoid valves 14 and 15 which are, in turn, responsive to electric current outputs from control device 18.

Control device 18 receives an engine speed signal from engine speed sensor 16 for detecting the revolution speed of engine 10. Accelerator dial 17 controls a commanded engine speed.

One part of a multi-pin connector 26 (shown both in its physical location in hydraulic hammer 1, and in its schematic location adjacent control 18) receives a plurality of cables 26*a* from control device 18. A second part of connector 26 is connected to a harness 26*a*. Certain terminals in harness 26*a* are connected to ground, and others remain unconnected. A resulting pattern of connected and unconnected terminals in harness 26*a* produces a bit pattern that is unique to a particular attachment. That is, the connection pattern shown, reading from the left, has the identity 0101, where 0 is ground and 1 is open. With a total of four terminals in harness 26*a*, a total of sixteen possibilities exist, as follows:

0000=0
0001=1
0010=2
0011=3
0100=4
0101=5
0110=6
0111=7
1000=8
1001=9
1010=10
1011=11
1100=12
1101=13
1110=14
1111=15

Thus, from the above, the example combination in FIG. 1*a* of 0101 identifies the characteristics of hydraulic hammer 1 with the decimal numeral 5. Each different attachment has permanently attached its associated connector 26 with a particular combination of connections and opens in harness 26*a*, whereby control device 18 is informed automatically of the identity of the attachment, and is thereby enabled to establish operating parameters in accordance with this identity. If more than 16 possible attachments require identification, one or more additional connections may be provided. For each additional connection, the number of possible identifications is doubled.

Pump control criteria output from control device 18 include the position of the accelerator of engine 10 that drives hydraulic pumps 8, 9, in other words the working distance of accelerator actuator 11, and respective pump powers controlled by pump regulators 12, 13.

Figure 1B:
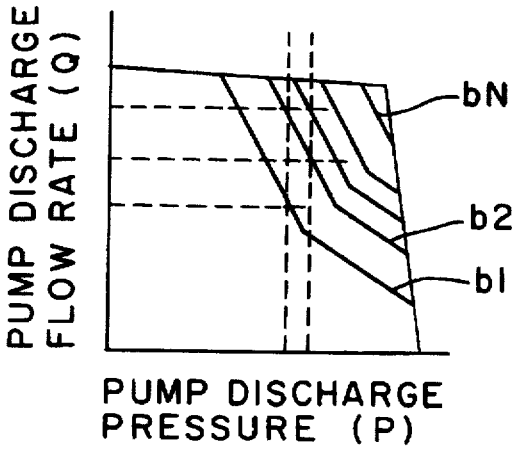
FIG. 1*b* is a pump output characteristic diagram showing the relationship between discharge pressure and discharge flow rate of hydraulic pumps.

Referring now to FIG. 1*b*, a pump output characteristic diagram shows the relationship between discharge pressure and discharge flow rate of hydraulic pumps 8, 9. Data of various rated pump outputs PS1, represented by curves b1, b2 . . . bN, are stored in the memory of control device 18. The curve corresponding to the attachment that is currently being used is selected based on the characteristic bit pattern specified by connector 26 mounted on the attachment. Thus, by selecting and outputting such control criteria as pressure and flow rate from control device 18 for each respective attachment, pumps 8, 9 are controlled at their design conditions.

Pressure switches 24, 25 receive pilot fluid pressures from pedal 6 which, in turn, controls fluid flow through control valve 4 to hydraulic hammer 1. The pressures detected by pressure switches 24, 25 inform control 18 through connecting circuits 24*a* and 25*a* that operation of the operating device (hydraulic hammer 1 in this embodiment) is being operated. In response, device 18 adjusts its output pump control criteria fed to solenoid valves 14 and 15 to accommodate the activation of hydraulic hammer 1.

Similarly, a pressure sensor 23 is connected to receive pilot fluid pressure from the boom-lowering side of lever type operating device 7. An output from pressure sensor 23 is connected to control 18. This output indicates the amount by which boom cylinder 2 is being actuated. In response to the signal from pressure sensor 23, control 18 adjusts its outputs connected to solenoid valves 14 and 15 to accommodate the increase or decrease in fluid flow and pressure required to satisfy the additional load of boom cylinder 2.

Figure 2:
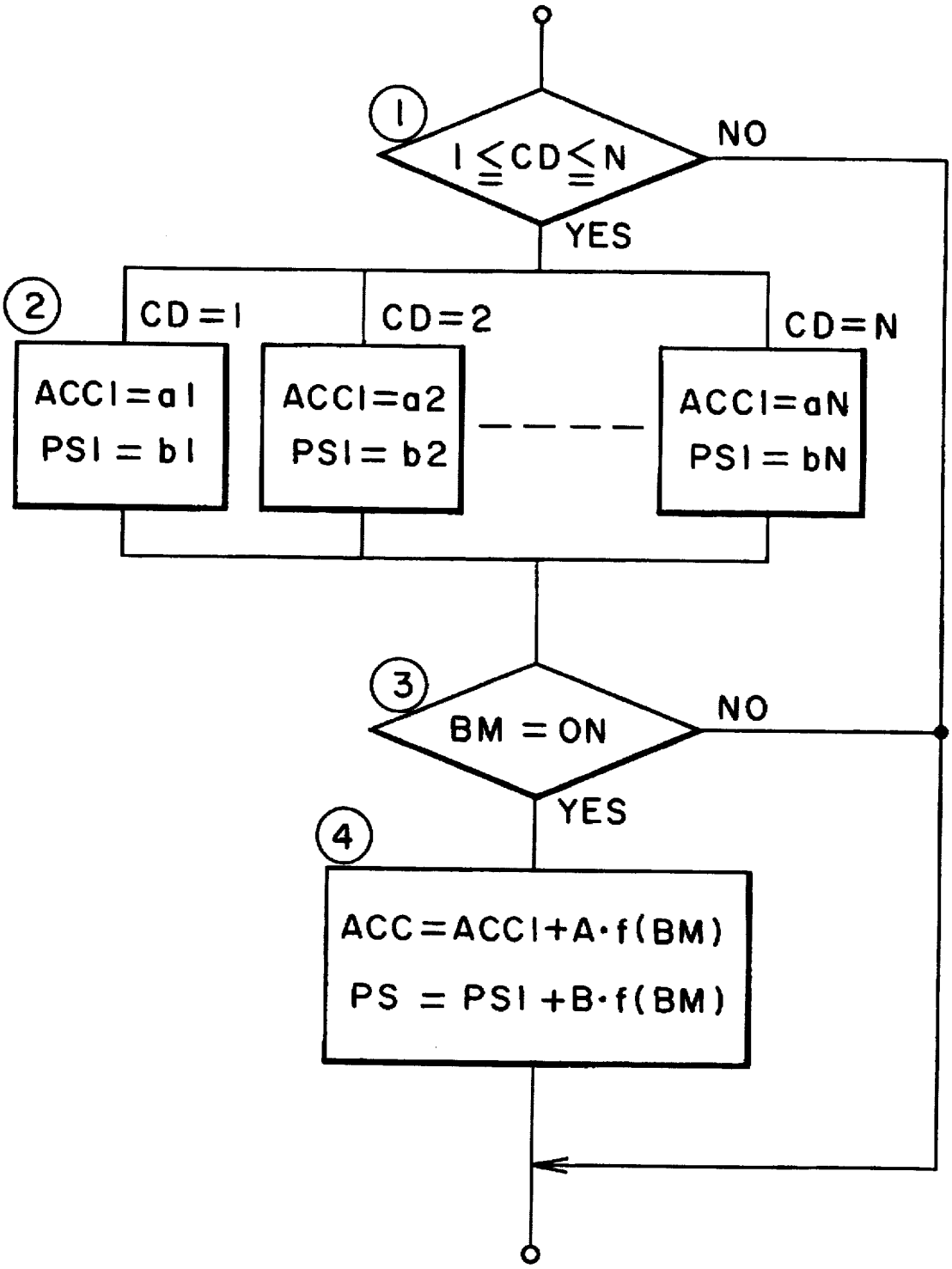
FIG. 2 is a flow chart of the control procedure of a control device incorporating the control system of FIG. 1.
Figure 3:
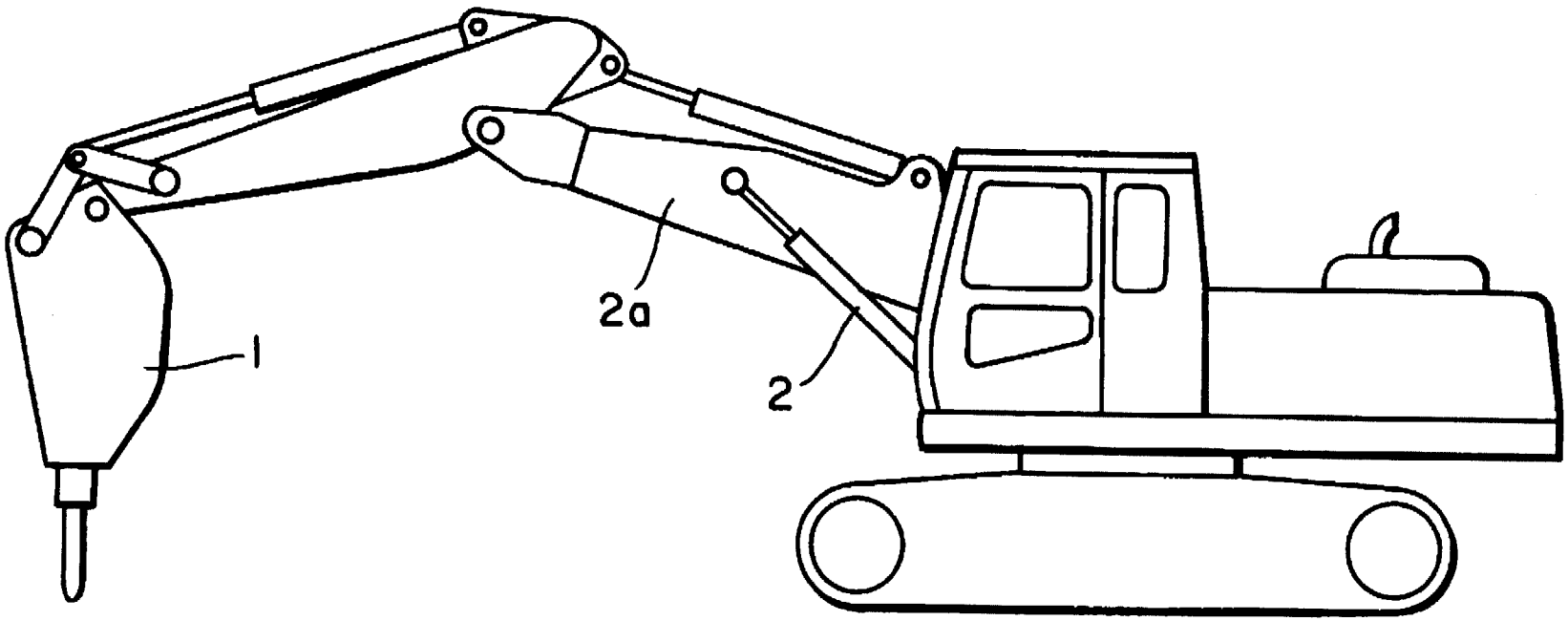
FIG. 3 is a side view of a construction machine wherein a hydraulic hammer is attached to a hydraulic excavator.
Figure 4:
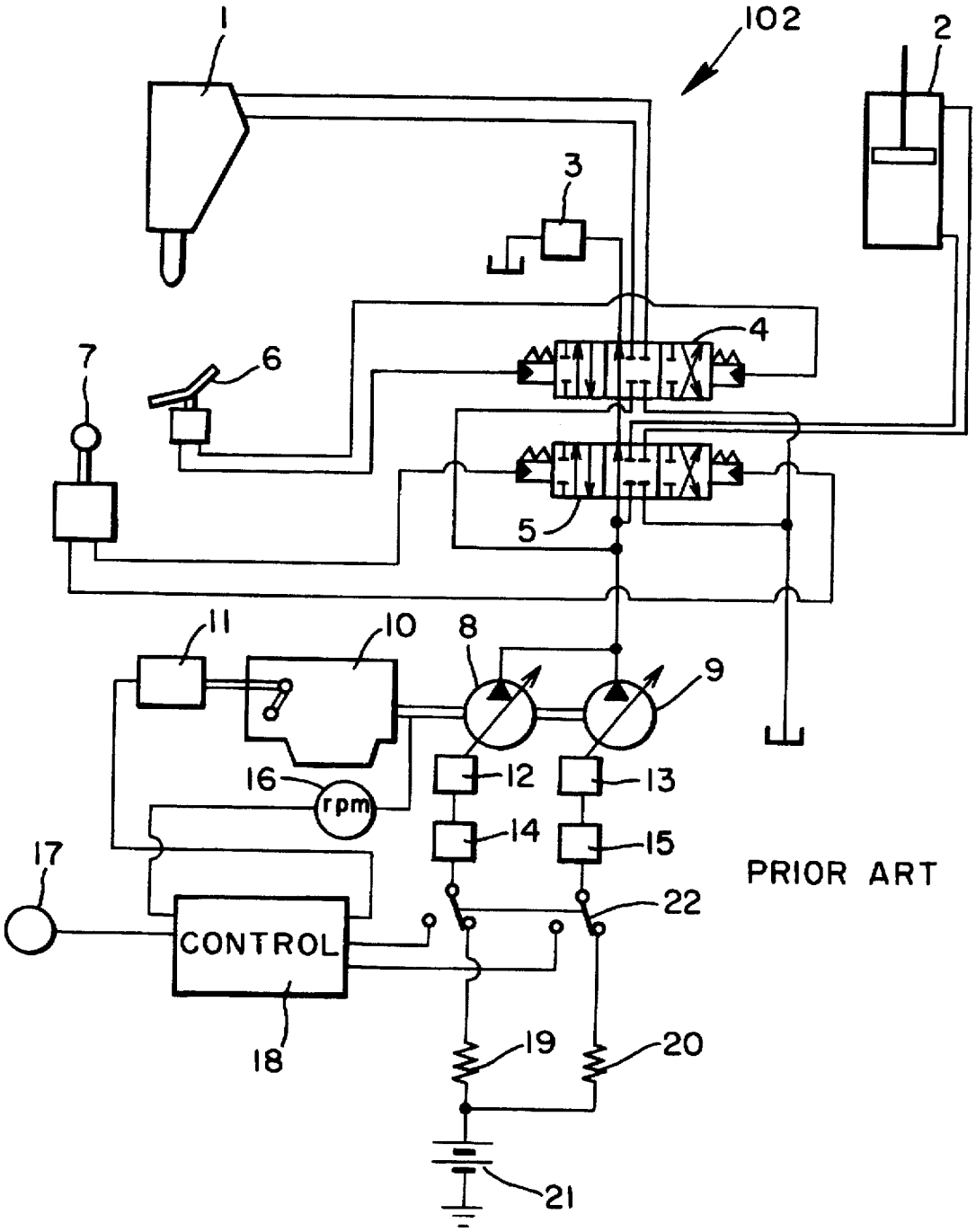
FIG. 4 is a circuit diagram of a conventional control circuit.

As shown in FIG. 2, control device 18 has a computing function to add correction criteria to the selected pump control criteria when lever type operating device 7 is moved in the direction to lower the boom. The correction criteria are computed based on the result of detection by pressure sensor 23, i.e. the degree of operation of control valve 5 of boom cylinder 2.

A desired attachment is mounted on the construction machine at the construction site, and the related connector 26 is mated. This automatically sets the criteria for controlling the pumps.

Various set values respectively corresponding to the aforementioned bit patterns are stored beforehand in a conventional memory in control device 18. Related to each possible bit pattern is a set of values for the position of the accelerator of engine 10 and respective outputs of pumps 8, 9.

As shown in FIG. 2, a bit pattern may be transformed into a numerical value CD (CD=1 to N). When any one of these numerical values is input (YES in Step 1), the control criterion that corresponds to the input value is chosen (Step 2) from among the preset criteria CD=1 to N in order to retrieve a single value each from ACC1=a1, a2, . . . , aN, which represents a position of the accelerator, and PS1=b1, b2, . . . , bN which represents a pump output, and, in cases where boom cylinder 2 is at a standstill in Step 3 (NO in Step 3), the position of its accelerator ACC1 and pump output PSI are output from control device 18.

Referring again to FIG. 1*a*, hydraulic hammer 1 is operated by means of pedal type operating device 6. To be more precise, by depressing pedal type operating device 6, hydraulic pilot pressure corresponding to the degree of the depression is applied to operate control valve 4. As a result, the amount of pressurized fluid discharged and fed from pumps 8, 9 to the attachment, i.e. hydraulic hammer 1, is controlled in accordance with the degree of operation of pedal type operating device 6.

At that time, signals indicating that the operating device has been operated are detected by pressure switches 24, 25 of the pilot pressure output circuit of pedal type operating device 6 and input to control device 18. Upon receiving these signals, control device 18 determines that pedal type operating device 6 has been operated and outputs preset values ACC1,PS1.

The acceleration signals output from control device 18 are input into accelerator actuator 11. Accelerator actuator 11 controls the position of the accelerator of engine 10. The pump drive signals are input to proportional control solenoid valves 14, 15, where they are transformed into hydraulic pressures. The resulting hydraulic pressures are respectively input into pump regulators 12, 13 to control outputs of hydraulic pumps 8, 9.

When using hydraulic hammer 1, it is customary to press hydraulic hammer 1 downward against the material being broken by urging boom 2*a* downward. Electrical signals from pressure sensor 23 in the pilot pressure output circuit at the boom-lowering side of lever type operating device 7, sensed by control device 18, adjust the fluid parameters of pressure and flow to accommodate simultaneous operation of boom 2*a* and hydraulic hammer 1.

The pilot pressure output circuit of lever type operating device 7 is connected to control valve 5. Therefore, by actuating control valve 5, the amount of pressure fluid fed from pumps 8, 9 to boom cylinder, is controlled in accordance with the degree of operation.

Then, when boom cylinder 2 is urged in the downward direction, in other words when boom 2*a* is urged downward, the pump discharge rate is increased in order to conform the driving speed for boom cylinder 2 to the command represented by signals from pressure sensor 23.

Referring again momentarily to FIG. 2, when boom cylinder 2 is operated simultaneously with operation of hydraulic hammer 1 (YES in Step 3), accelerator position ACC is corrected by adding the increased distance of the accelerator position, i.e. A.f (BM), to accelerator position ACC1 that has been selected in Step 2. At the same time, pump output PS, is corrected by adding the required amount of increase of the pump output, i.e. B.f (BM), to pump output PS1 that has been selected in Step 2 (Step 4). A and B are coefficients, and f(BM) represents the function of a degree by which lever type operating device 7 is operated.

The ability to adjust pump discharge rate in response to output values (ACC,PS), computed by control device 18, permits control to adapt to changing conditions, including the shift between operation of hydraulic hammer 1 alone, and simultaneous operation of hydraulic hammer 1 and boom cylinder 2.

A circuit according to the invention includes means for selecting a set of pump control criteria that correspond to the attachment to be used from among a plurality of pump control criteria set in a control device, and detectors for detecting the state of operation of the attachment and for causing the control device to output the pump control criterion selected by the control criteria selecting means. Therefore, the pump flow rate and other conditions appropriate for the attachment can be maintained throughout its operation.

The control criteria selecting means comprises connectors attached to different attachments. Each connector has a plurality of cables in which a bit pattern is set by selectively grounding, and leaving open certain cables in a pattern uniquely associated with that attachment. In this manner, the fluid parameters required for an attachment on the construction machine is automatically selected, without error, among the possible control criteria respectively associated with a variety of attachments simply by connecting the connector of the selected attachment through harnesses to the control device that is provided at the main body of the construction machine.

When a detector detects installation of a different actuator, the control device adds correction values, which have been computed based on the degree of operation of this new actuator, to the pump control criteria that have been chosen as above. The control device then outputs the corrected control criteria. Therefore, even when an attachment is simultaneously operated with another actuator, the control system of the present invention adapts to driving both properly by automatically correcting the originally selected pump control criteria in accordance with the operating condition of the other actuator, thereby ensuring a pump discharge rate sufficient for simultaneous operation of the attachment and the actuator.

The pump control criteria comprise outputs of the respective pumps in addition to responses to the position of the accelerator of the engine that drives the pumps. Therefore, when a variety of attachments are used, the invention ensures a supply of hydraulic fluid at the optimum pump discharge pressure and flow rate required by the combination of attachments that is currently used.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A control circuit of a machine having at least an attachment and an actuator comprising:

at least one pump for feeding hydraulic fluid to said attachment and said actuator;

a first control valve controlling said flow of said hydraulic fluid to said attachment;

a second control valve controlling said flow of said hydraulic fluid to said actuator;

a control device for controlling discharge rate of said at least one pump;

a control criteria selecting means in said control device for selecting from among at least first and second pump control criteria;

said first pump control criterion corresponding to a first attachment, and said second pump control criterion corresponding to a second, different attachment;

a coding device uniquely associated with each of said first and second attachments; and means connected to said control device and associated with said coding device, for detecting which specific one of said first attachment and said second attachment is affixed to said machine, and for selecting the related one of said first and second pump control criteria.

2. A control circuit as claimed in claim 1, wherein:

said coding device includes a first connector attached to said first attachment and a second connector attached to said second attachment;

said first and second connectors each having a plurality of cables;

a pattern of grounding said first and second connectors in different bit patterns to provide unique identification of the associated attachment; and the connector attached to the currently used attachment being connected to said control device of said construction machine.

3. A control circuit as claimed in claim 1, further comprising:

means for detecting operation of said actuator;

said pump control criteria further containing at least one correction value to the already chosen pump control criteria; and adjusting the selected pump control criteria to accommodate said at least one correction value, whereby both said attachment and said actuator are operable together.

4. A control circuit of a construction machine as claimed in claim 1, wherein said pump control criteria includes control criteria for said at least one pump and control criteria for controlling a position of an accelerator of an engine that drives said at least one pump.

5. A control circuit for a machine having at least a first and a second attachment attachable to said machine, comprising:

a first coding device affixed to said first attachment;

a second coding device affixed to said second attachment;

said first coding device being attached to said control circuit when said first attachment is installed on said machine;

said second coding device being attached to said control circuit when said second attachment is installed on said machine;

means in said control device for detecting a unique code in said first or second coding device;

said control device including at least a first control criteria related to said first attachment, and at least a second control criteria related to said second attachment; and means for applying said first control criteria to control said first attachment when said unique code identifies said first attachment, and for applying said second control criteria to control said second attachment when said unique code identifies said second attachment.

6. A control circuit according to claim 5, wherein said first and second control criteria each include at least a fluid flow and an accelerator setting.

* * * * *